US009461412B2

(12) United States Patent
Yu et al.

(10) Patent No.: US 9,461,412 B2
(45) Date of Patent: Oct. 4, 2016

(54) ELECTRICAL CONNECTOR WITH IMPROVED TONGUE

(71) Applicant: FOXCONN INTERCONNECT TECHNOLOGY LIMITED, Grand Cayman (KY)

(72) Inventors: Chun-Ming Yu, Kunshan (CN); Hao Zhou, Kunshan (CN); Bing-Bo Hu, Kunshan (CN); Ke-Hao Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/882,402

(22) Filed: Oct. 13, 2015

(65) Prior Publication Data

US 2016/0104976 A1 Apr. 14, 2016

(30) Foreign Application Priority Data

Oct. 13, 2014 (CN) ..... 2014 2 0587151 U

(51) Int. Cl.

| | |
|---|---|
| ***H01R 13/648*** | (2006.01) |
| ***H01R 13/6585*** | (2011.01) |
| ***H01R 24/60*** | (2011.01) |
| *H01R 107/00* | (2006.01) |

(52) U.S. Cl.

CPC ..... *H01R 13/6585* (2013.01); *H01R 24/60* (2013.01); *H01R 2107/00* (2013.01)

(58) Field of Classification Search

CPC ..... H01R 23/7073; H01R 4/64; H01R 13/65802; H01R 23/688; H01R 13/7197; H01R 13/514; H01R 23/6873

USPC ..... 439/79, 92, 95, 108, 607.01, 607.02, 439/607.28, 607.05–607.15, 607.4, 660

See application file for complete search history.

(56) References Cited

U.S. PATENT DOCUMENTS

| | | | | |
|---|---|---|---|---|
| 8,109,795 | B2 * | 2/2012 | Lin | H01R 13/6461 439/660 |
| 8,251,746 | B2 * | 8/2012 | Zhang | H01R 13/6581 439/607.11 |
| 8,808,029 | B2 * | 8/2014 | Castillo | H01R 13/6585 439/607.05 |
| 8,851,927 | B2 * | 10/2014 | Hsu | H01R 13/6594 439/607.11 |
| 9,022,800 | B2 * | 5/2015 | Yang | H01R 13/6581 439/487 |
| 9,136,649 | B2 * | 9/2015 | Shih | H01R 13/658 439/607.11 |
| 9,178,319 | B2 * | 11/2015 | Little | H01R 13/6585 439/607.05 |
| 9,281,642 | B1 * | 3/2016 | Tseng | H01R 24/60 439/607.4 |
| 9,312,641 | B2 * | 4/2016 | Wang | H01R 13/6585 439/607.01 |

FOREIGN PATENT DOCUMENTS

TW M467207 U 12/2013

* cited by examiner

*Primary Examiner* — Thanh Tam Le

(74) *Attorney, Agent, or Firm* — Wei Te Chung; MING CHIEH CHANG

(57) ABSTRACT

A receptacle connector for mating with the plug connector, includes an insulative housing and two rows of terminals. The housing includes a main body and a mating tongue forwardly extending from the main body and forming two opposite mating surfaces. Each of the terminals includes a front mating section and a rear mounting section. The mating tongue forms a plurality of passageways to receive the mating sections of the corresponding terminals therein, respectively. The housing further forms a plurality of holes communicatively behind the some passageways in the vertical direction for increase the impedance of the corresponding terminal on the mating sections, respectively.

9 Claims, 10 Drawing Sheets

ELECTRICAL CONNECTOR WITH IMPROVED TONGUE

BACKGROUND OF THE INVENTION

1. Field of the Invention

The present invention relates to an electrical connector assembly, and more particularly to an electrical connector with improvements to the impedance.

2. Description of Related Art

Type C USB specification was issued on Aug. 11, 2014 in which a fine pitch and fine width of the contact arrangement is required. Because the impedance around the mating section of the contact in the connector is relatively lower than that in other places (due to the total cross-section thereabouts including the coupling terminal), it is desired to raise the impedance thereabouts for make the impedance consistency along the whole contact.

A new structure of the receptacle connector is desired.

SUMMARY OF THE INVENTION

A receptacle connector for mating with the plug connector, includes an insulative housing and two rows of terminals. The housing includes a main body and a mating tongue forwardly extending from the main body and forming two opposite mating surfaces. Each of the terminals includes a front mating section and a rear mounting section. The mating tongue forms a plurality of passageways to receive the mating sections of the corresponding terminals therein, respectively. The housing further forms a plurality of holes communicatively behind the some passageways in the vertical direction for increase the impedance of the corresponding terminal on the mating sections, respectively.

DETAILED DESCRIPTION OF THE PREFERRED EMBODIMENT

Figure 1:
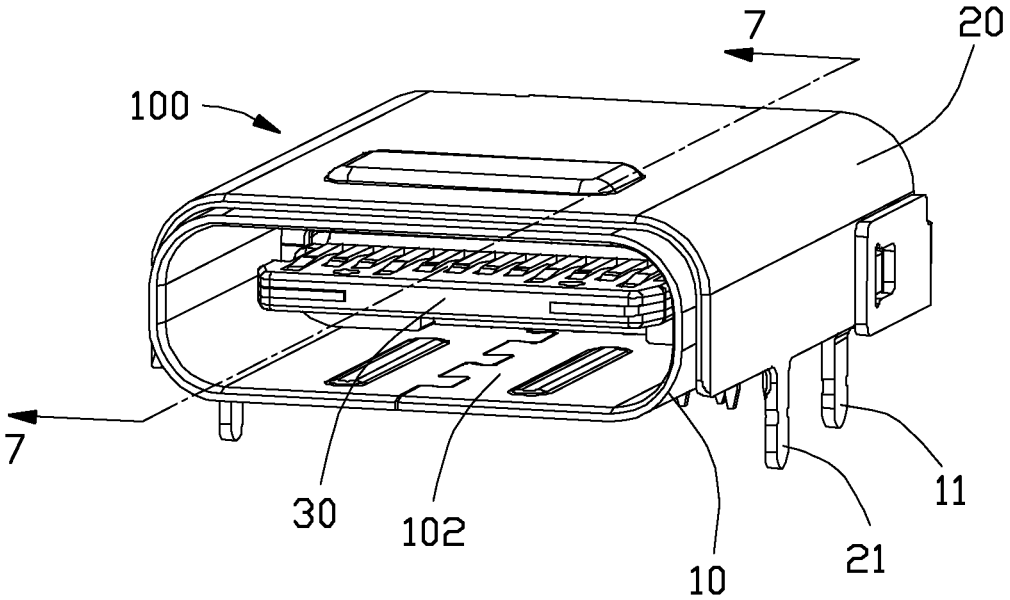
FIG. 1 is an assembled perspective view of a receptacle connector assembly in accordance with the present invention.
Figure 2:
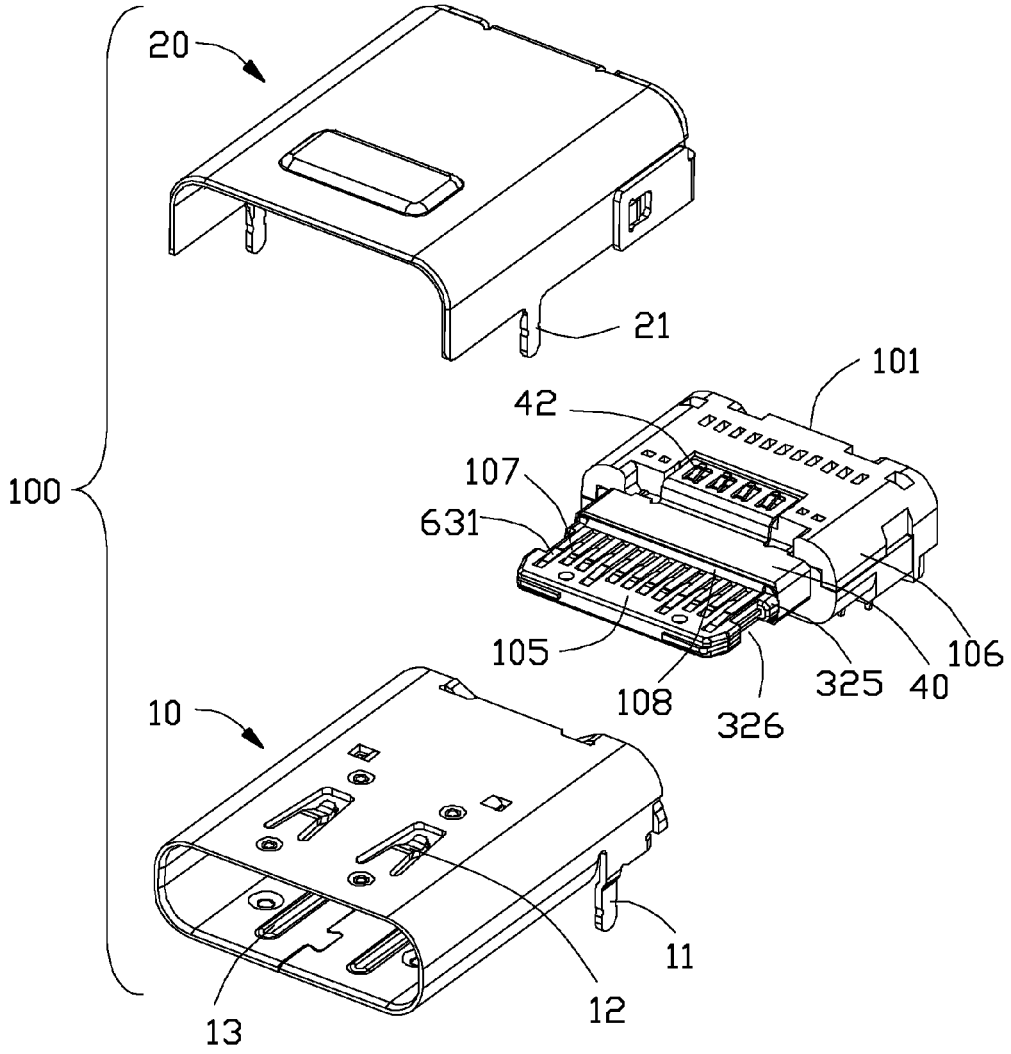
FIG. 2 is an exploded perspective view of the receptacle in FIG. 1.
Figure 3:
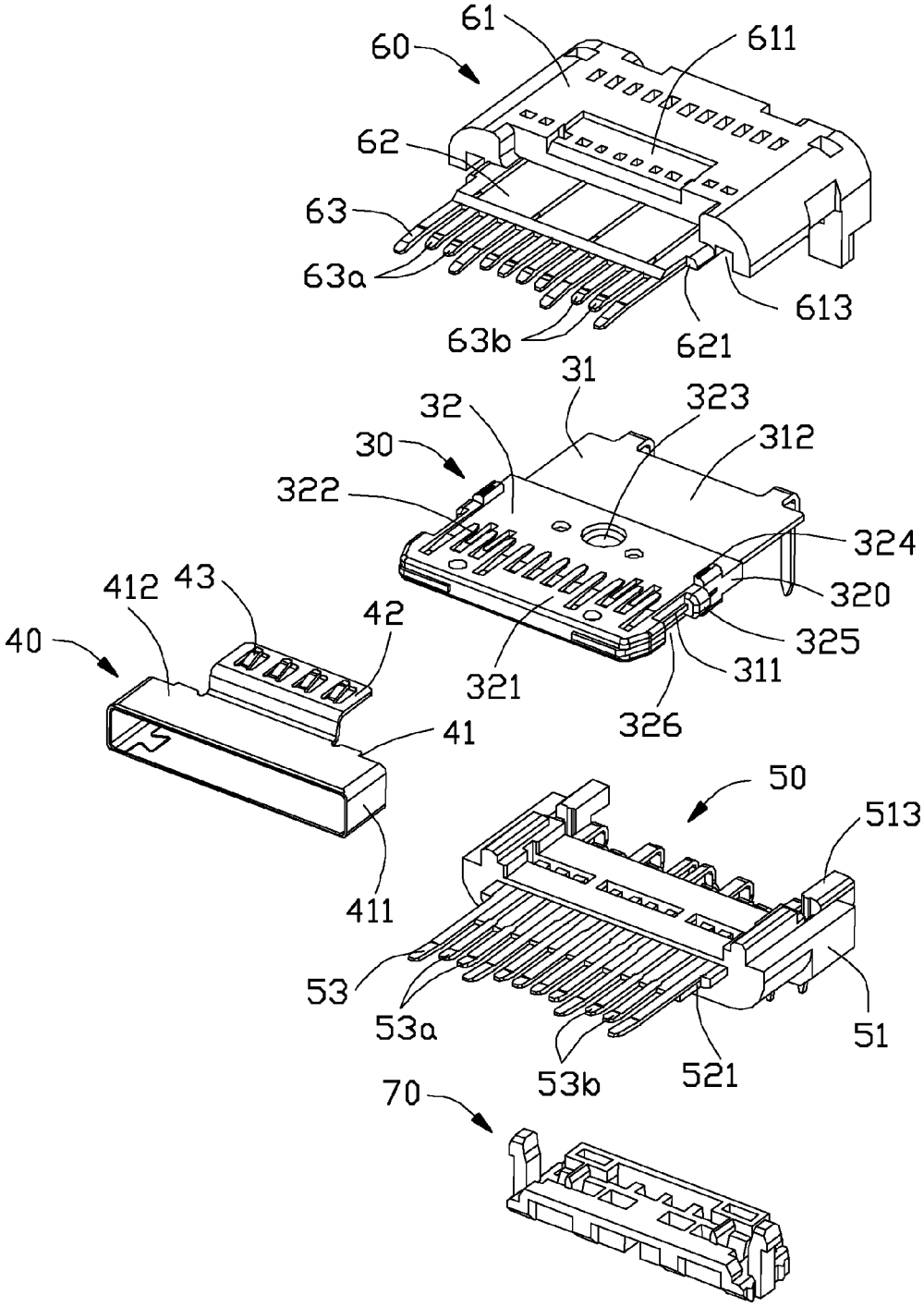
FIG. 3 is a further exploded perspective view of the receptacle connector in FIG. 2.
Figure 4:
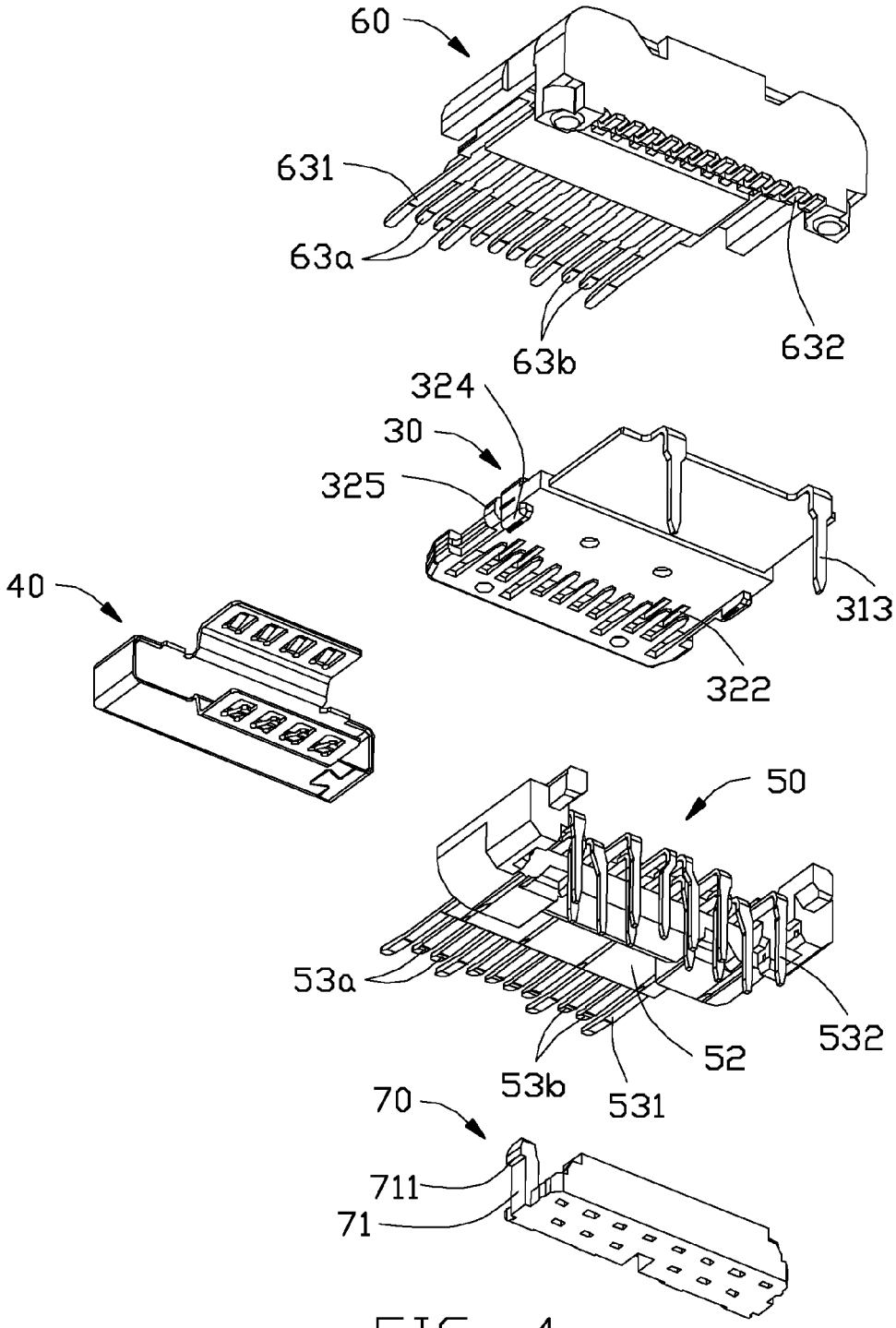
FIG. 4 is another exploded perspective view of the receptacle connector in FIG. 3
Figure 5:
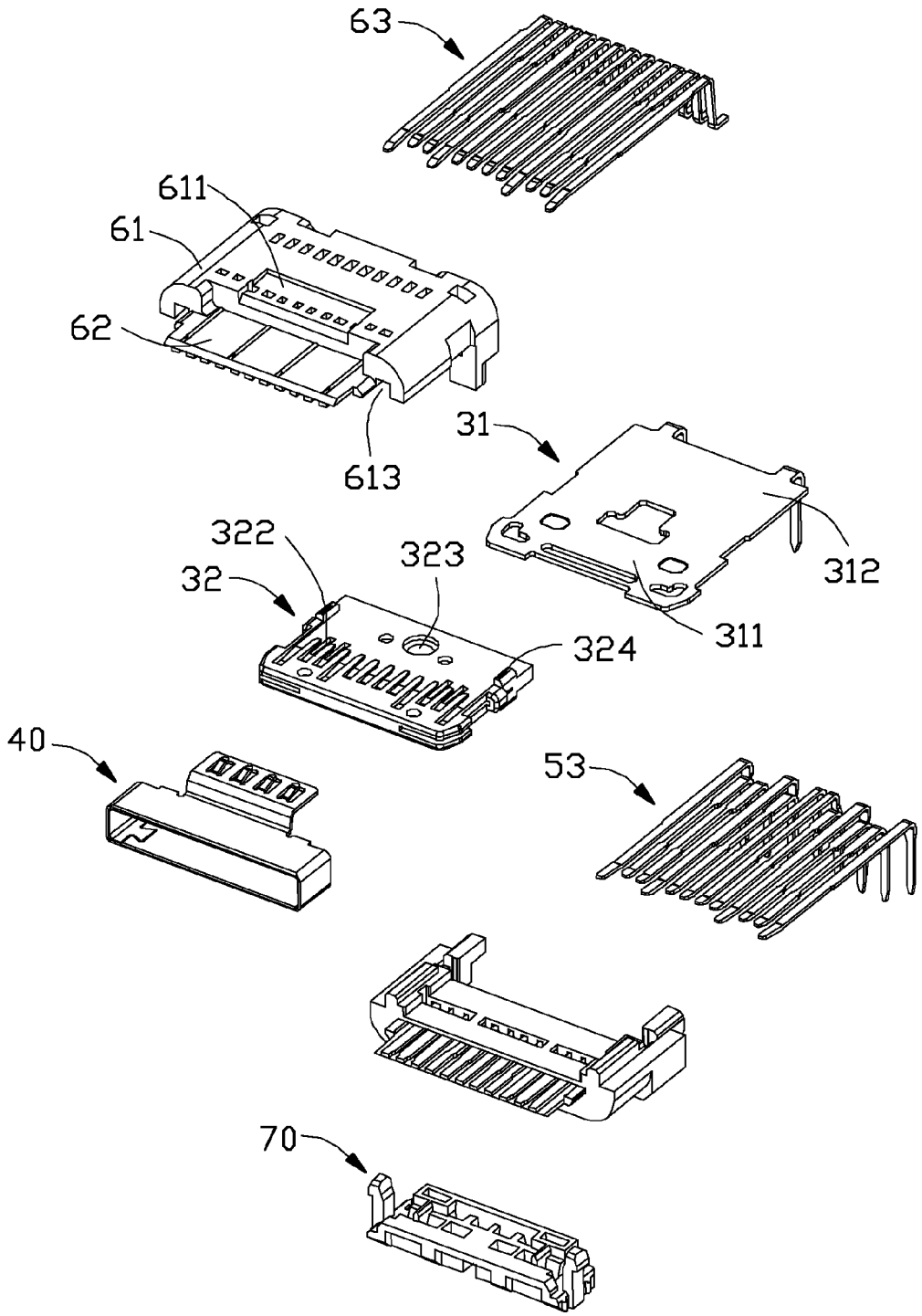
FIG. 5 is a further exploded perspective view of the receptacle connector in FIG. 3.
Figure 6:
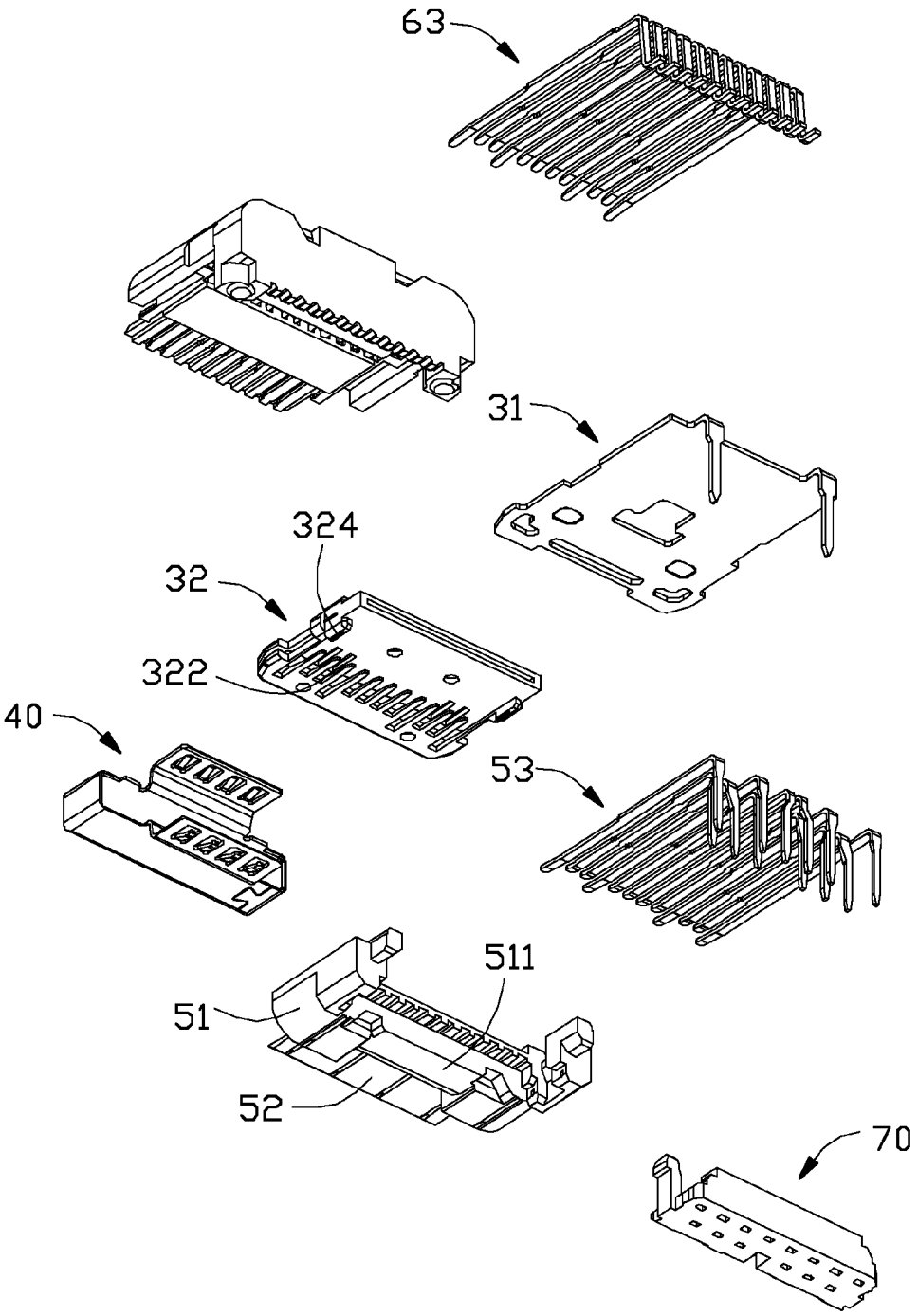
FIG. 6 is another exploded perspective view of the receptacle connector in FIG. 5.
Figure 7:
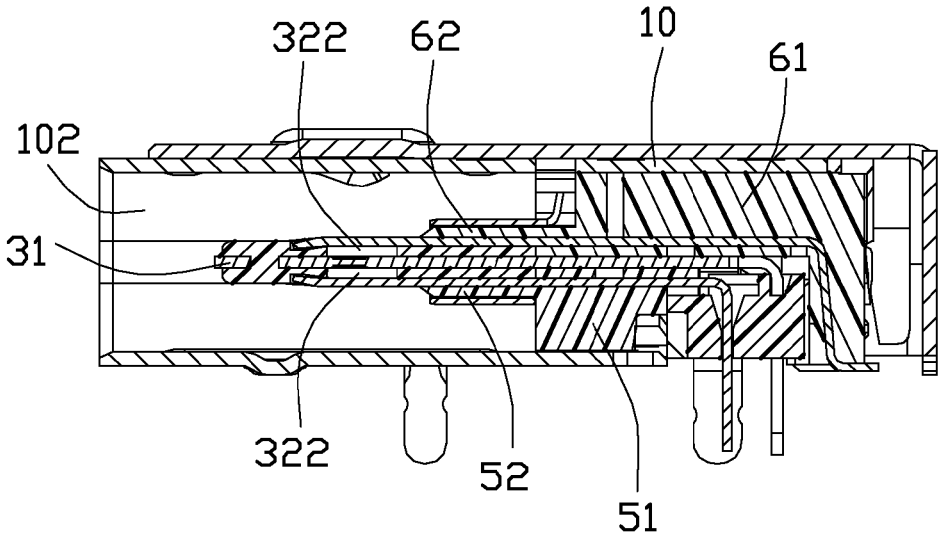
FIG. 7 is a cross-sectional view of the receptacle connector in FIG. 1
Figure 8:
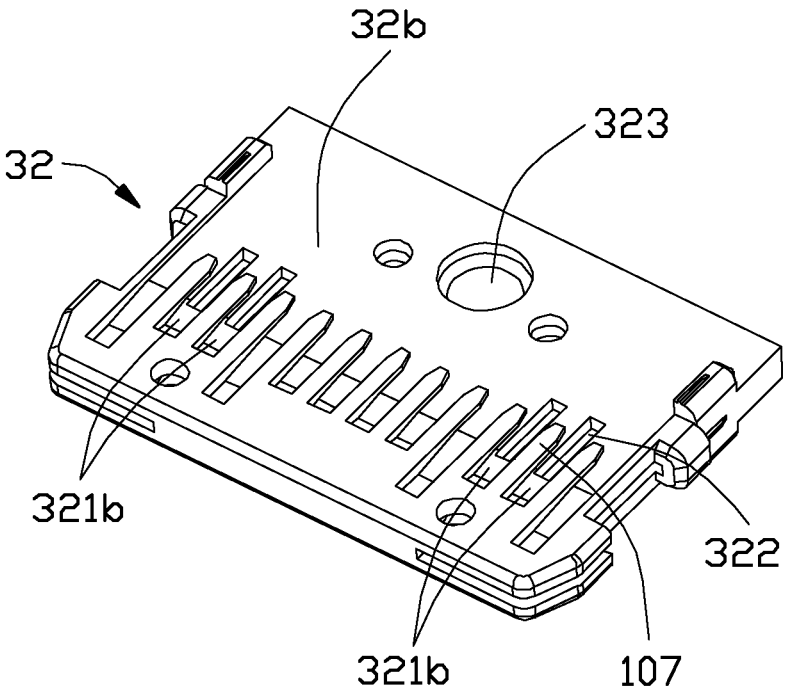
FIG. 8 is a perspective view of the insulative tongue of the receptacle connector in FIG. 1.
Figure 9:
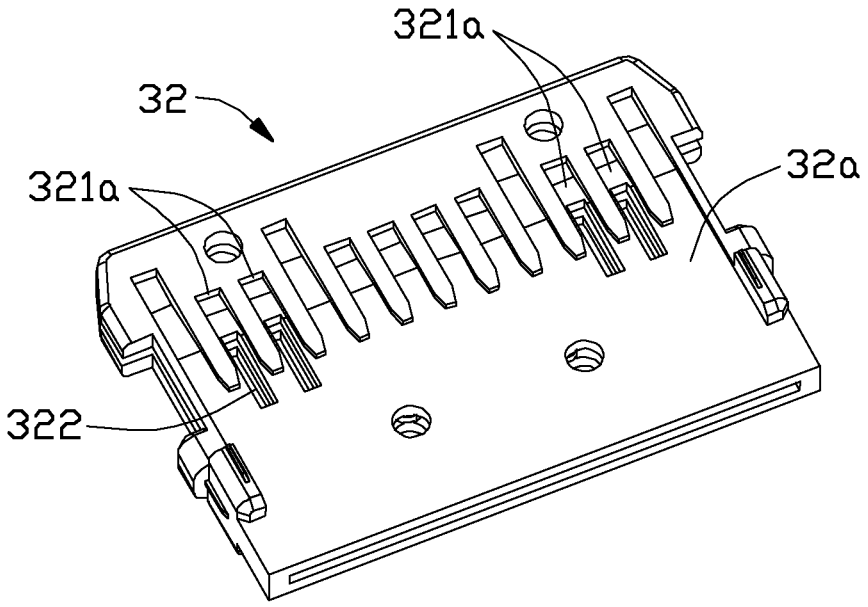
FIG. 9 is another perspective view of the insulative tongue of the receptacle connector in FIG. 1.
Figure 10:
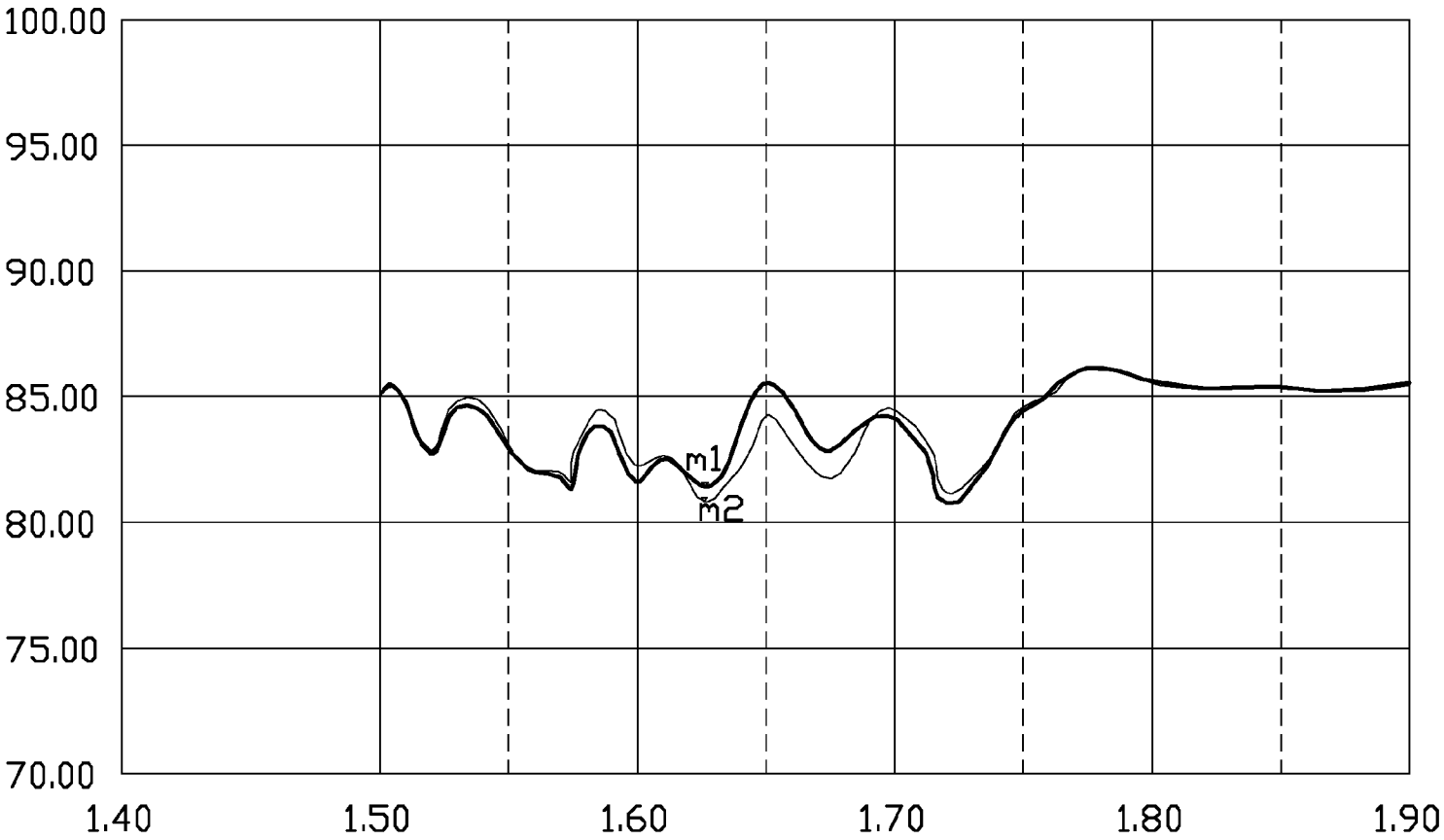
FIG. 10 is a diagram showing the impedance change in response to the dimension of the hole.

Referring to FIGS. 1 through 10, an electrical receptacle connector 100 for mating with a plug connector (not shown), includes a terminal module assembly 101 enclosed within a metallic shield 10 which is attached under a metallic bracket 20. The terminal module assembly 101 includes rear insulative main body 106 and a front insulative mating tongue 105 forwardly extending from the mating body 106. The mating tongue 105 forms two opposite surfaces. Two rows of contacts 53 and 63 include the mating sections 531, 631 exposed upon the mating tongue 103, and the mounting sections 532, 632 extending outside of the main body 106.

The mating tongue 105 forms holes 322 corresponding to the mating sections 531, 631 of some contacts 53, 63. The mating tongue 105 forms a plurality of passageways for receiving the mating sections 532, 632, and the ribs 107 between every adjacent two passageways. The ribs 107 are spaced from the main body 106 with a distance in the front-to-back direction. The mating tongue 105 forms a step 108 around the root proximate the mating body 106. The step 108 is equipped with the grounding collar 40. The mating tongue 105 is equipped with a metallic shielding tongue 105, and each hole 32 extends through the mating tongue 105 while being intercepted by the shielding plate 31 optionally.

The metallic shield 10 is assembled upon the terminal module assembly 101. The shield 10 is assembled upon the main body 106 to surround the mating tongue 105 and the corresponding grounding collar 40 so as to form a mating cavity 102 therebetween. The shield 10 forms the spring tangs 12 and the ribs 13 extending into the mating cavity 102, and mounting legs 11.

The metallic bracket 20 is fixed upon the shield 10 via welding. The bracket 20 includes the mounting legs 21 in front of the mounting legs 11 for mounting to the printed circuit board on which the connector 100 is seated. The bracket 20 covers the top side and two lateral sides and the rear side with the surface mount soldering points for auxiliary mounting.

The terminal module assembly 101 includes the grounding collar 40, the upper terminal module 60, the lower terminal module 50, the tongue module 30 between the upper terminal module 60 and the lower terminal module 50, and the spacer 70. The lower terminal module 50 includes an insulative lower body 51, the lower step 52 in front of the lower body 51 and the lower contacts 53. Each lower contact 53 includes a front mating section 531 and a rear mounting section arranged in two rows. The lower contacts 53 are insert-molded within the lower body 51. The lower contacts includes the grounding contacts, the power contacts, and two differential pairs of which one pair 53*a* is for transmission and the other pair 53*b* is for reception. The step 52 forms cutouts 521. The spacer 70 forms through holes (not labeled) to receive the mounting sections 532. The spacer 70 forms latches 71 with hooks 711 thereon.

Similar to the lower terminal module 50, the upper terminal module 60 includes an insulative upper body 61, the upper step 62 in front of the upper body 61, and the upper contacts 63. Each upper contact 63 includes a front mating section 631 and a rear mounting section 632 arranged in two rows. The upper contacts 63 are insert-molded within the upper body 61. The upper step 62 forms cutouts 621. The upper contacts includes grounding contacts, power contacts and two differential pairs of which one pair 63*a* is for transmission and the other 63*b* is for reception. In this embodiment, the holes 322 are only formed behind the corresponding differential pairs 63*a*, 63*b*, 53*a* and 53*b* in the vertical direction.

The tongue module 30 includes an insulative tongue 32 ad the shielding plate 31 wherein the front region 311 of the shielding plate 31 is embedded within the insulative tongue 32 while the front edge and the two side edges of the shielding plate 31 are exposed outside of the front edge and the two side edges of the insulative tongue 32. The insulative tongue 32 includes a front contact region 321 and the rear fixing region 320. Abutment sections 325 are formed adjacent to the fixing region 320. The blocks 324 are located upon the boundary between the contact region 321 and the fixing region 320. Notches 326 are formed to expose the shielding plates 31. The grounding collar 40 includes a main body 41 and two plates 42 rearwardly extending from the main body 41. Each plate 42 forms a plurality of spring tabs 43.

The upper terminal module 60 and the lower terminal module 50 commonly sandwich the tongue module 30 therebetween 30 to form the terminal module assembly 101 wherein a front portion of the insulative tongue 32 forms the mating tongue 105, and the upper body 62 and the lower body 52 commonly form the main body 106. the upper step 62 and the lower step 52 common form the step 108. The grounding collar 40 covers the step 108.

The insulative tongue 32 forms the passageways in the upper surface to receive the mating sections 631 of the corresponding upper contacts 63 wherein the passageways 32 lb receive the corresponding differential pairs 63*a*, 63*b*, and in the lower surface to receiving the mating sections 531 of the corresponding lower contacts 53 wherein the passageways 321 a receive the corresponding differential pairs 53*a*, 53*b*. Each of the passageways 321*a* and 321*b* is equipped with one hole 322. Each hole 322 extends rearwardly behind the ribs 107. A width of the hole 322 is smaller than a width of the mating section 631, 531 of the differential pairs 63*a*, 63*b*, 53*a*, 53*b*. The length of the hole 322 can be varied according the diagram shown in FIG. 10. In this embodiment, the length is 1.2 mm and the width is 0.2 mm, the rising time is 40 ps according to the range of 20%-80%, and the result is 1Ω rising. A plurality of round holes 323 are used for insert-molding the shielding plate 31 in the insulative tongue 32.

The upper contacts 63 are insert-molded within the upper body 61, and the lower contacts 53 are insert-molded within the lower body 51. The shielding plate 31 is insert-molded within the insulative tongue 32. In this embodiment, the grounding collar 40 is first assembled with the tongue module 30 and the upper terminal module 90 and the lower terminal module 50 are respectively forwardly inserted through the upper and lower spaces formed between the grounding collar 40 and opposite upper and lower sides of the tongue module to have the mating section 631 of the upper contacts 63 and the mating sections 531 of the lower contacts 53 received within the corresponding passageways. Notably, the cutouts 521, 621 of the lower terminal module 50 and the upper terminal module 60 are engaged with the blocks 324 to prevent relative movement therebetween along the front-to-back direction. The lower terminal module 50 forms the ribs 513 to be received within the grooves 613 of the upper terminal module 60. The mounting sections 532 of the lower contacts 53 extend through the corresponding through holes of the spacer 50. The hooks 711 are engaged within a recess (not labeled) in the lower body 51 to fix the upper terminal module 60 and the lower terminal module 50. The main body 41 of the ground collar 40 is seated upon the upper and lower steps 62, 52. The upper terminal module 60 forms a recess 611 and the lower terminal module 50 forms a recess 511 to receive the plates 42, respectively. The feature of the invention is to provide the holes 322 behind the corresponding passageways which receive the differential pairs. Notably, such holes 322 may extend with a sufficient distance as a through hole to expose the shielding plate 31 in the vertical direction. Also, the shielding plate 31 may form a corresponding through aperture in alignment with the through hole 322 so as to have the hole 322 extend through the whole mating tongue 105 in the vertical direction. Another feature of the invention is to have the mating sections 631, 531 of the neighboring contacts 63. 53 exposed to each other in the transverse direction with a distance along the front-to-back direction because the ribs 107 are terminated at one half of the length of the insulative tongue 32. Therefore, the portion of the mating section 531, 631 which is located around the rear end region of the hole 322, is essentially fully circumferentially exposed to an air rather than confront the insulative material. Another feature is to have the hole 322 extend along the front-to-back direction not beyond a transverse line defined by front ends of the pair of abutment sections 325 so as to assure the strength of the whole mating tongue 105.

What is claimed is:

1. An electrical connector comprising:

an insulative housing including a main body and a mating tongue forwardly extending from the main body in a front-to-back direction and defining opposite mating surfaces thereon in a vertical direction perpendicular to said front-to-back direction;

a plurality of contacts disposed in the housing, each of said contacts defining a front mating section and a rear mounting section, said contacts including grounding contacts, power contacts and differential pairs for signals;

a plurality of passageways formed in each of the mating surfaces to receive the plurality of contacts;

a metallic shielding plate is embedded within the mating tongue at a mid-level; and corresponding passageways of plurality of passageways receiving the differential pairs therein, each corresponding passageway equipped with each hole communicatively located behind the mating section of a corresponding differential pairs in the vertical direction to raise impedance of the mating section;

wherein each hole extends with a distance to expose the shielding plate in the vertical direction;

wherein the mating tongue forms a plurality of ribs on the mating surfaces to separate the plurality of passageways in a transverse direction perpendicular to both said front-to-back direction and said vertical direction; and wherein the holes extend rearwardly along said front-to-back direction beyond said ribs and also extend to reach a level in the vertical direction, where the metallic shielding plate is located.

2. The electrical connector as claimed in claim 1, wherein a width of the hole, which is measured in a transverse direction perpendicular to both said front-to-back direction and said vertical direction, is smaller than a width of the mating section of the corresponding contact received in the corresponding passageway.

3. The electrical connector as claimed in claim 1, wherein the mating section of the corresponding contact behind the rib is exposed to that of the neighboring contact in a transverse direction perpendicular to both said front-to-back direction and said vertical direction.

4. The electrical connector comprising:

a terminal module enclosed within a metallic shield and including:

a tongue module sandwiched between opposite upper terminal module and lower terminal module in a vertical direction, the tongue module defining a metallic shielding plate embedded within an insulative tongue, the upper terminal module including a plurality of upper contacts insert-molded within an insulative upper body, and the lower terminal module including a plurality of lower contacts insert-molded within an insulative lower body; and a plurality of ribs each extending along a front-to-back direction perpendicular to said vertical direction, located on opposite mating surfaces of the insulative tongue to form a plurality of passageways therebetween in a transverse direction perpendicular to said vertical direction and said front-to-back direction;

wherein a corresponding of the plurality passageways receive a mating section of a corresponding contact belong to differential pairs, is equipped with each hole communicatively located behind the mating section of the corresponding contact in the vertical direction;

wherein a width of each hole in said transverse direction is smaller than a width of the mating section of the corresponding contact;

wherein the mating section of the corresponding contact around a rear region of each hole, is exposed to that of a neighboring contact in the transverse direction;

wherein each hole extends forwardly in the front-to-back direction not beyond a front end of the corresponding passageway, and wherein the holes extend rearwardly along said front-to-back direction beyond said ribs and also extend to reach a level in the vertical direction, wherein the shielding plate is located.

5. The electrical connector as claimed in claim 4 wherein the insulative tongue includes a pair of blocks on two lateral sides on which a grounding collar is assemble thereon.

6. The electrical connector as claimed in claim 5, wherein an upper space is formed between the grounding collar and an upper face of the insulative tongue to allow the mating sections of the upper contacts of the upper terminal module to be forwardly inserted through said upper space to reach the corresponding passageways, and a lower space is formed between the grounding collar and a lower face of the insulative tongue to allow the mating sections of the lower contacts to be forwardly inserted through said lower space to reach the corresponding passageway.

7. The electrical connector as claimed in claim 4 wherein said ribs are terminated before reaching one half length of the insulative tongue in the front-to-back direction while said holes extend beyond said one half length in said front-to-back direction.

8. The electrical connector as claimed in claim 7, wherein said insulative tongue further includes a pair of abutment sections on two lateral sides to prevent a forward movement of a grounding collar which is secured to a rear region of the insulative tongue, and the hole extends rearwardly not beyond a transverse line defined between said pair of abutment sections.

9. An electrical connector comprising:

an insulative mating tongue defining opposite two mating surfaces in a vertical direction;

a plurality of ribs formed on the mating surface and extending along a front-to-back direction perpendicular to said vertical direction;

a plurality of passageways alternately formed between the ribs in a transverse direction perpendicular to both said vertical direction and said front-to-back direction;

a plurality of contacts with corresponding mating sections received within the corresponding passageways, respectively;

a plurality of holes formed in the mating tongue and communicatively located behind some of said mating sections, respectively, in the vertical direction;

wherein each mating section around a rear end of each hole, is exposed to that of a neighboring mating section in the transverse direction;

wherein the holes in the opposite mating surfaces, which are aligned with each other in the vertical direction, originally communicate with each other in said vertical direction but being blocking by a metallic shielding plate which is embedded within the mating tongue; and wherein the holes extend rearward along said front-to-back direction beyond said the ribs and also extend to reach a level in the vertical direction, where the metallic shielding plate is located.

* * * * *